United States Patent [19]

Covert

[11] 3,953,817

[45] Apr. 27, 1976

[54] FLASHER DEVICE

[75] Inventor: James P. Covert, Schaumburg, Ill.

[73] Assignee: Littelfuse, Inc., Des Plaines, Ill.

[22] Filed: Aug. 5, 1974

[21] Appl. No.: 494,874

[52] U.S. Cl. ..... 337/136; 337/92; 337/138

[51] Int. Cl.[2] ..... H01H 61/06; H01H 61/01

[58] Field of Search ..... 337/138, 92, 136, 135

[56] References Cited

UNITED STATES PATENTS

| | | | |
|---|---|---|---|
| 2,659,787 | 11/1953 | Prickett | 337/138 |
| 2,687,459 | 8/1954 | Midgley | 337/135 |
| 2,820,120 | 1/1958 | Flatt et al. | 337/135 |
| 2,897,318 | 7/1959 | Finch | 337/92 |
| 3,218,411 | 11/1965 | Siiberg | 337/138 |
| 3,609,619 | 9/1971 | Yokohama et al. | 337/136 |

*Primary Examiner*—Harold Broome

*Attorney, Agent, or Firm*—Wallenstein, Spangenberg, Hattis & Strampel

[57] ABSTRACT

A flasher device includes a terminal with an inner extension carrying a stationary contact thereon, the extension supporting a conductive heat responsive means connected to another terminal of the device and having a movable contact thereon, an insulating member sandwiched between the heat responsive means and the terminal extension by a metal rivet having a head portion bearing against one of the terminal extension and heat responsive means, a shank passing through the insulating member and in spaced relationship to the defining walls of an aperture in the terminal extension through which it passes, and a staked end bearing against a washer insulating it from the other of same. The insulating member preferably has positioning projections extending into correspondingly sized apertures in the heat responsive means and the terminal extension to fix their relative position thereof. A heating coil is electrically connected across the heat responsive means and the terminal extension.

9 Claims, 19 Drawing Figures

FIG. 3
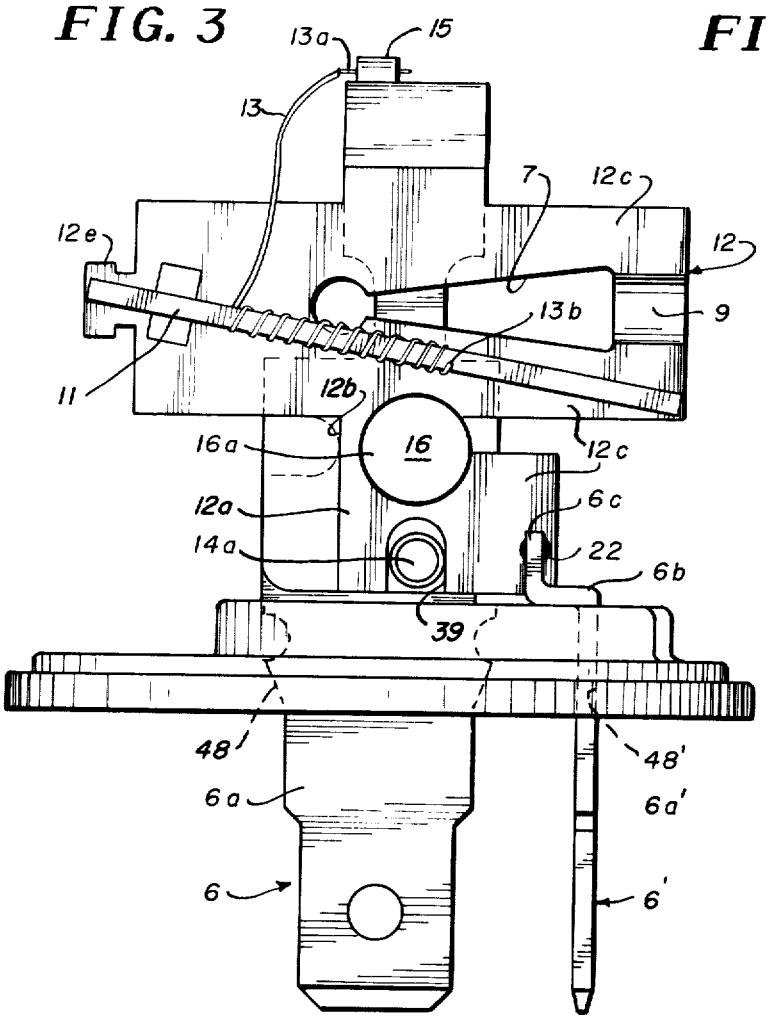
FIG.4A
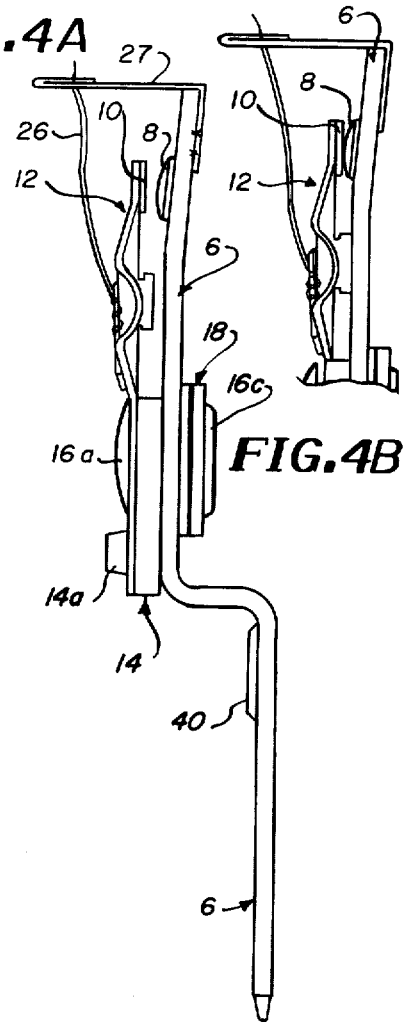
FIG.4B
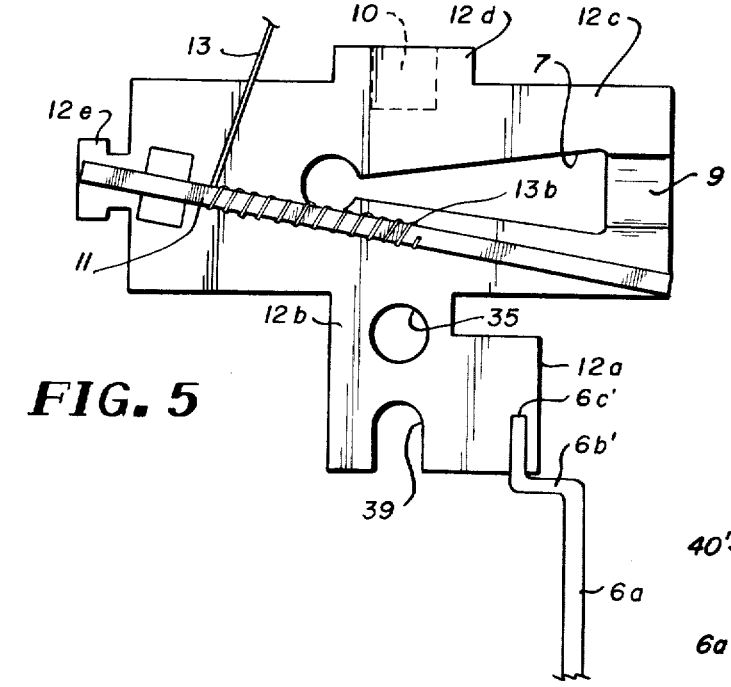
FIG. 5
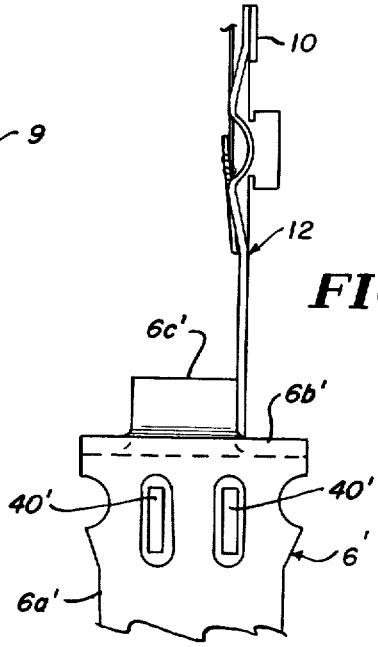
FIG. 6

FIG. 12
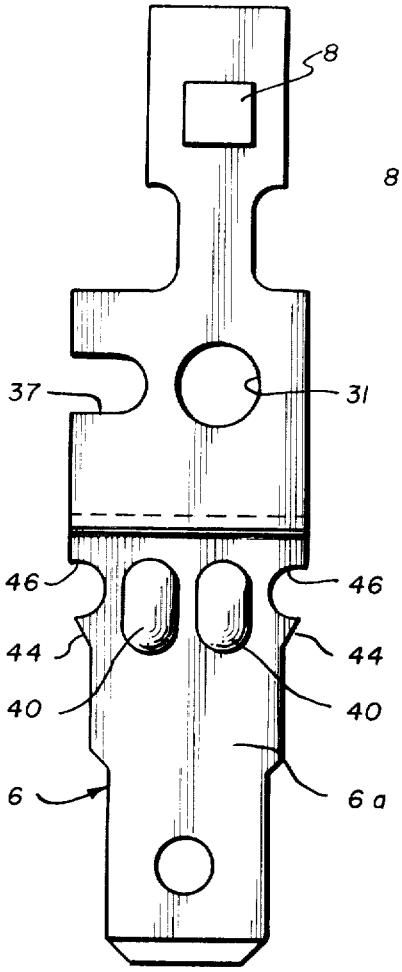
FIG. 13
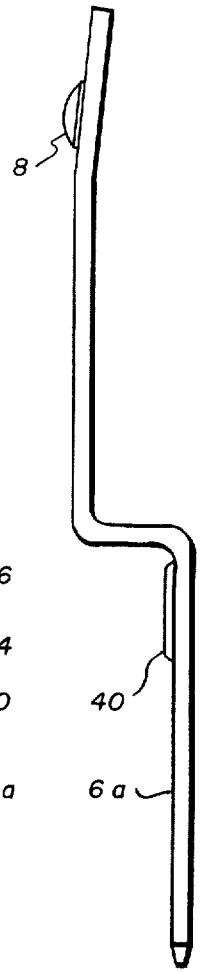
FIG. 15
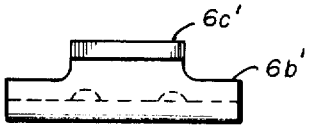
FIG. 14
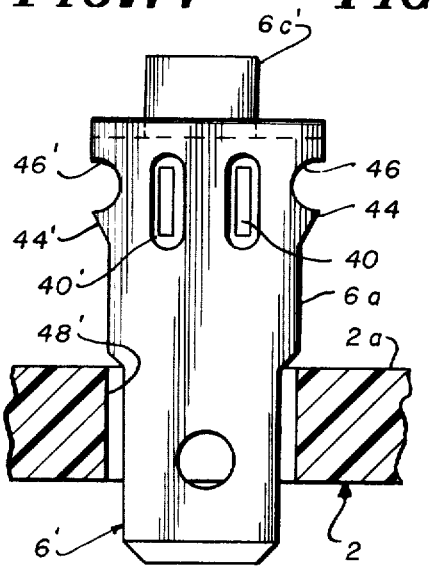
FIG. 16
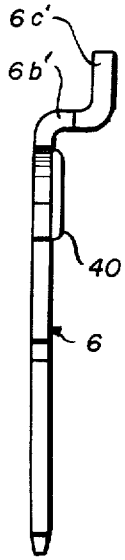
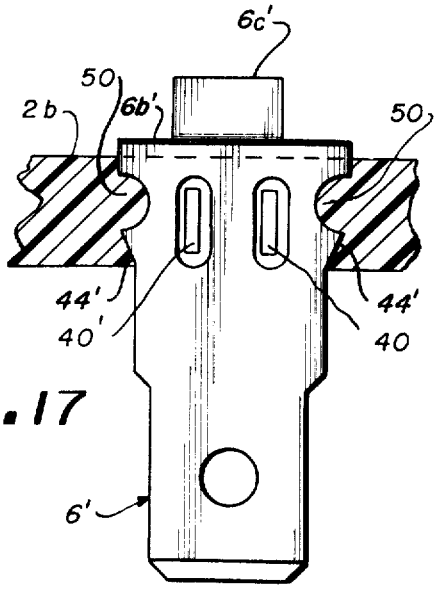
FIG. 17
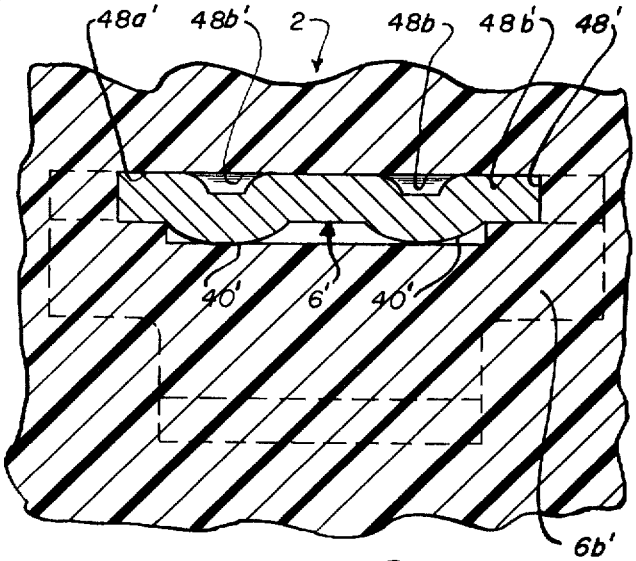
FIG. 18

FLASHER DEVICE

BACKGROUND OF THE INVENTION

This invention relates to plug-in terminal current control devices, and while some aspects thereof deal with such control devices generally, it has its most important application in flasher devices used, for example, in automobiles to interrupt the flow of current to the tail lights thereof to provide a warning light indication.

Flasher devices of the type described being an important safety device in an automobile must be made with a high degree of reliability. Also, the cost of such devices becomes an important objective to the manufacturer. Reliability and low cost are generally difficult to achieve simultaneously.

A flasher device of the type described generally includes a support base having a pair of plug-in terminals extending therefrom and a movable contact carrying arcuately bent blade electrically connected to one of the terminals. The other terminal of the device is commonly provided with a conductive extension carrying a stationary contact in confronting relationship to the movable contact of the heat responsive blade. The heat responsive blade commonly includes an actuator ribbon extending therefrom and a heater coil wound on the actuator ribbon is electrically connected between the heat responsive blade and the terminal extension. The actuator ribbon is heated initially by current flow in the heater coil until the ribbon reaches a temperature where it expands to a point permitting the blade to snap into a contact closing position to short circuit current flow through the heating coil. The actuator ribbon will thus be alternately heated and cooled to effect opening and closing of the movable and stationary contacts alternately to energize and de-energize the electrical circuit into which the flasher device is placed.

The assembly of such a flasher device generally requires a number of welding or soldering operations electrically to connect the various parts of the device to one another and to the one or more terminals thereof. It has been heretofore recognized that the reliability of a flasher device progressively decreases as the number of solder or welding points in the path of the current flow and the number of parts of the device increases. Also, since the ability of a flasher device properly to operate depends, in part, upon the maintenance of a pre-determined positioning between the movable and stationary contacts, it becomes important to design the flasher device so vibration and other forces applied to it do not disturb this proper positioning of the stationary and movable contacts. It is, therefore, one of the objects of the invention to provide a flasher device as described wherein the number of solder or welding points thereof are reduced to increase the reliability thereof. A related object of the invention is to provide a flasher device as described which is made of fewer parts than prior flasher devices. A still further object of the invention is to provide a flasher device as described wherein vibration and other forces applied thereto do not disturb the proper relative positioning of the movable and stationary contacts. An overall object of the invention is to provide a flasher device having one or more of the advantageous features just described, and further which can be easily and economically assembled.

SUMMARY OF THE INVENTION

In the most preferred form of the invention, three conductive parts in addition to the movable and stationary contacts carried by two of the parts are in the main path of flow of current between the terminals, and current flows through only a single weld in comparison to two or more welds in prior flasher device designs. The reliability of such a flasher device is, therefore, enhanced appreciably. Additionally, in the most preferred form of the invention, the heat responsive blade is carried by and anchored to an extension of one of the terminals which carries the stationary contact, and correct positioning of the heat responsive blade upon the terminal extension is determined by means which assure precise positioning of the heat responsive blade, the movable contact carried thereby and the stationary contact carried by the terminal extension.

The above features are best achieved by the use of an insulating member interposed between the terminal extension and the heat responsive blade. The insulating member is provided with locator means interfitting with portions of the terminal extension and heat responsive blade when the heat responsive blade is properly positioned upon the terminal extension. The insulating member and heat responsive blade are most preferably anchored to the terminal extension by a metal rivet having a head portion bearing against one of the heat responsive blade and the terminal extension, a shank portion passing through the insulating member in spaced relationship to the defining walls of an aperture of the terminal extension, and a staked end which bears against an insulating washer sandwiched between it and the other of the same.

The flasher device to be described also has other unique features, such as the design of the terminals and the method used to anchor the terminals on the support base. Moreover, a unique support base and cover construction is utilized.

DESCRIPTION OF THE DRAWINGS

FIG. 3 is a side elevational view of the flasher device with the cover removed;

FIG. 4A is a side elevational view of a terminal and heat responsive blade assembly constituting a part of the flasher device shown in FIG. 3 when viewed at right angles to the position shown in FIG. 3;

FIG. 4B is a view of the upper portion of the terminal and heat responsive blade assembly shown in FIG. 4A when the heat responsive blade has moved to a position where it is forced into a contact closing position;

FIG. 5 is a view of the heat responsive blade shown in FIG. 3 and one of the terminals of the flasher device welded thereto;

FIG. 6 is a side elevational view of the terminal and heat responsive blade shown in FIG. 5;

FIG. 12 is an elevational view of the terminal member of the flasher device which acts as the main support for the heat responsive blade and the insulating member referred to;

FIG. 13 is an end elevational view of the terminal of FIG. 12;

FIG. 14 is a side elevational view of the other terminal of the flasher device as it is being inserted into an aperture in the support base;

FIG. 15 is a plan view of the terminal member shown in FIG. 14;

FIG. 16 is an end elevational view of the terminal member shown in FIG. 14;

FIG. 17 is a view of the terminal shown in FIG. 14 after the terminal has been mounted in the aperture of the support base shown in FIG. 14 by an ultrasonic welding; and FIG. 18 is an enlarged horizontal sectional view through the support base shown in FIG. 17.

DESCRIPTION OF THE PREFERRED EMBODIMENT OF THE INVENTION

Figure 1:
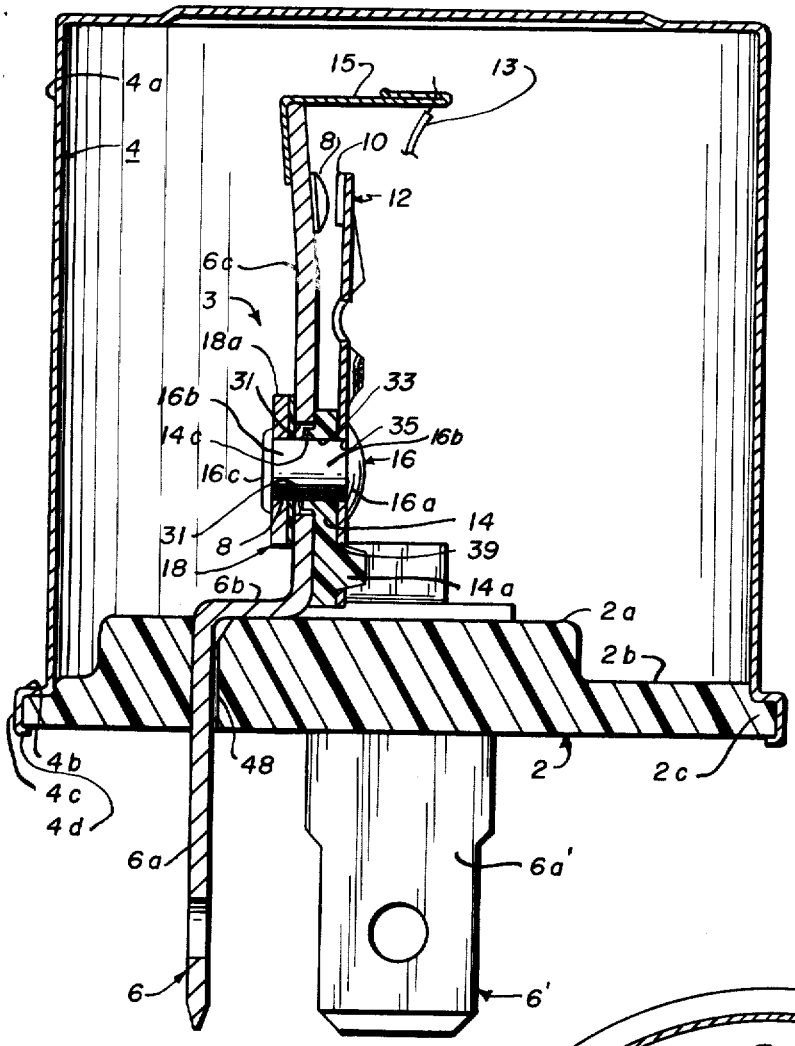
FIG. 1 is an enlarged vertical sectional view through the most preferred form of flasher device of the invention.
Figure 2:
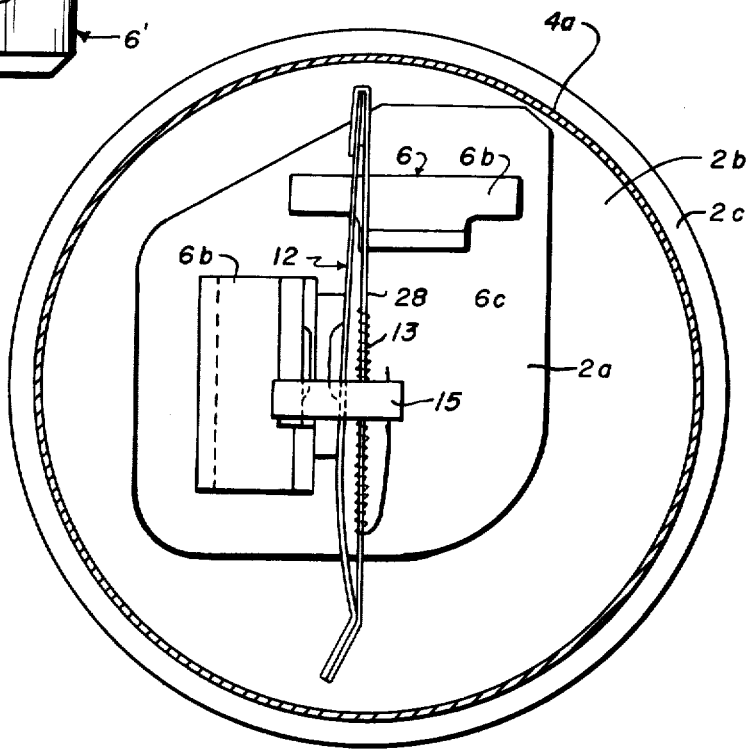
FIG. 2 is a top plan view of the flasher device with the cover thereof removed.

Referring now more particularly to FIGS. 1 and 2, the flasher device there illustrated comprises a support base 2 preferably made of a molded synthetic thermoplastic material having insulating qualities, such as Nylon or other similar material. The support base 2 forms the bottom wall of a housing assembly which is completed by an inverted cup-shaped cover 4 which is preferably made of metal and is secured around a thin resilient perimeter 2*c* of the support base by rolling or otherwise bending the bottom perimiter of the cover 4 tightly around the thin perimeter 2*c* of the support base about the entire extent thereof. Generally, support bases of flashers or the like are made from a relatively frangible bakelite type material which cannot withstand the forces which a tight interfitting of the perimeter of a cover all along its extent. As illustrated, the cover 4*a* has a radially outwardly extending flange 4*b* which rests upon the upwardly facing surface of the thin perimeter 2*c* of the support base, a short cylindrical wall 4*c* depending from the outer margin of the flange 4*b* and snugly engaging the cylindrical outer surface of the thin perimeter 2*c* of the support base, and an inturned portion 4*d* underlying the support base 2. If the support base 2 were made of a material like bakelite which is relatively frangible, a tight engagement of the entire perimeter of the bottom portion of the cover member about the support base would crack the support base. A much more reliable and secure interconnection between the cover 4 and the support base is achieved when the support base is made of the type of insulating material described and the cover is connected thereto as described.

The support base 2 has a relatively thick central portion 2*a* through which terminals 6 and 6′ project below the support base where they can be extended into a receiving socket electrically to connect the flasher device to an external circuit. The manner in which the terminals 6 and 6′ interfit with and are mounted within support base 2 constitutes another aspect of the present invention to be explained more fully hereinafter. Suffice it to say at this point, this process requires that the support base 2 may be made of a thermoplastic material of which Nylon is one example. Base 2 has a thick portion 2*a* projecting upwardly from a portion 2*b* of intermediate thickness between that of the thin perimeter 2*c* and the thicker portion 2*a* thereof.

The terminal 6 has a terminal-forming bottom portion 6*a* which projects downwardly from the support base 2 through the thick portion 2*a* of the support base, a narrow intermediate portion 6*b* which extends along the upper surface of the thick portion 2*a* of the support base and an upwardly extending portion to be referred to as a terminal extension 6*c* which acts as a support for the rest of the components of the flasher device to be described.

A stationary contact 8 is secured to the end portion of the terminal extension 6*c* to make a good electrical connection therewith. The stationary contact 8 made of a suitable forming material is positioned in confronting relationship to a movable contact 10 secured to a heat responsive blade 12 to make a good electrical connection therewith. The heat responsive blade 12 may have any suitable configuration, the configuration illustrated being one of many configurations presently used on flasher devices. The heat responsive blade 12 is a member which has an upper horizontally elongated rectangular portion 12*c* (FIG. 3) which, in the absence of external forces, assumes a generally arcuate shape opposite to that illustrated in FIGS. 1 and 2 where the movable contact 10 carried on the inner face thereof is spaced from the stationary contact 8 carried by the terminal extension 6*c*. The heat responsive blade 12 also has a neck portion 12*b* terminating in a base portion 12*a* (FIG. 5).

The heat responsive blade 12 is supported in a very unique manner upon the terminal extension 6*c* and is connected to the other terminal 6′ of the flasher device so that only a single weld is necessary in the main path of current flow between the terminals 6 and 6′.

The upper rectangular portion 12*c* of the blade has a key-shaped aperture 7 and an indented end portion 9. A ribbon 11 of metal or the like is secured between a tab 12*e* projecting from one side of the upper rectangular portion 12*c* of the blade 12 and a portion on the opposite end thereof. Heating means in the form of an insulated heating wire 13 winds around the ribbon 11. The heating wire 13 has a bare end 13*a* soldered to a conductive arm 15 shown soldered or welded to the side of the terminal extension 6*c* opposite to the side containing the stationary contact 8, as best shown in FIG. 1. The heating wire 13 has an opposite bare end which is soldered or secured to the ribbon 11. When current flows through the heating wire 13, the ribbon 11 elongates to a point where the rectangular portion 12*c* of the blade 12 snaps into its initial unstressed arcuate configuration where the movable contact 10 thereof engages the stationary contact 8, as shown in FIG. 4B. When the ribbon 11 cools, it contracts to pull the upper rectangular portion 12*c* of the blade 12 into its contact opening configuration. When contacts 8 and 10 are in engagement, an electrical circuit into which the flasher devices is connected is closed and when the contact 8 and 10 separate the circuit has inserted therein a relatively high impedance of the heating wire 13 which is insufficient to effect energization of an incandescent lamp or the like used as a tail light in an automobile.

Figure 7:
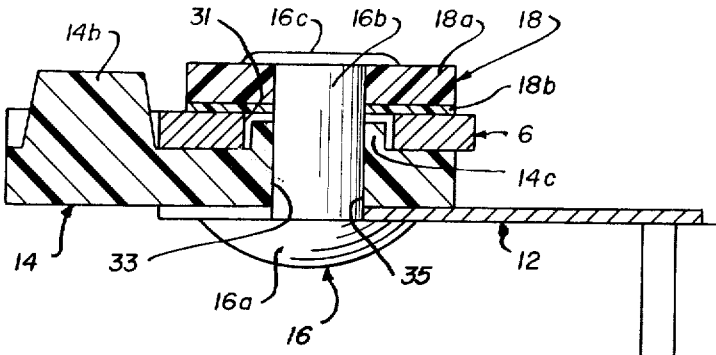
FIG. 7 is a horizontal sectional view through the assembly shown in FIG. 3, taken along section line 7—7 therein.
Figure 8:
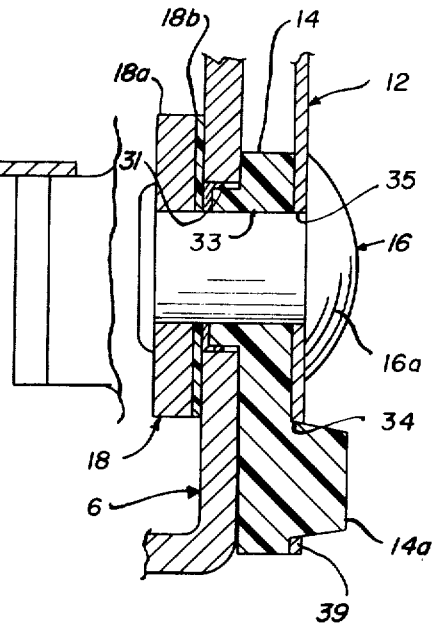
FIG. 8 is a vertical sectional view through a portion of the assembly shown in FIG. 3, taken along section line 8—8 therein.
Figure 9:
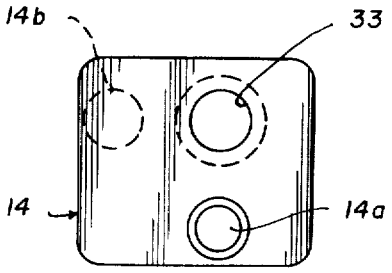
FIG. 9 is a vertical elevational view of the insulating member constituting one of the parts of the assembly of FIG. 3.
Figure 10:
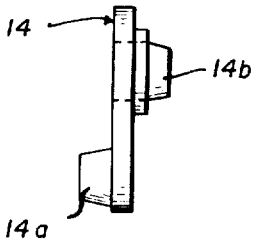
FIG. 10 is an end elevational view of the insulating member shown in FIG. 9.
Figure 11:
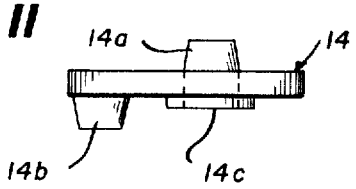
FIG. 11 is a plan view of the insulating member shown in FIG. 9.

Anchoring and positioning means are provided for supporting the heat responsive blade 12 upon the terminal extension 6c in a manner which assures a given predetermined spacing and positioning between the blade and movable contact 10 carried thereby and the stationary contact 8 carried on the terminal 6c. The support means includes an insulating member 14 made of a suitable synthetic plastic insulating material. The insulating member 14 has a main body portion sandwiched between the heat responsive blade 12 and the bottom portion of the terminal extension 6c. The insulating member 14 and the heat responsive blade 12 are anchored to the terminal extension 6c most advantageously by a metal rivet 16 having a head portion 16a bearing against the outer surface of the blade 12, a shank portion 16b passing through an aperture 35 in the blade 12, (FIG. 7) an aperture 33 in the insulating member 14 and an aperture 31 formed in the terminal extention 6c. The shank 16b of the rivet 16 is kept in spaced relation from the defining walls of the terminal extension aperture 31 by a portion 14c of the insulating member which projects within the terminal extension aperture 31. The rivet 16 has a staked end 16c bearing against the outer face of a washer 18 which has an outer metal portion 18a and an inner insulated portion 18b which insulates the metal portion 18a of the washer from the terminal extension 6c.

The insulating member 14 serves also as a positioning means for precisely relating the heat responsive blade 12 and the movable contact 10 carried thereby with respect to the stationary contact 8 carried on the terminal extension 6c. To this end, the side of the insulating member 14 facing the blade 12 has projecting therefrom a positioning nib 14a which passes through a correspondingly shaped downwardly open, elongated slot 39 formed in the base portion 12a of the blade 12. Projecting from the side of the insulating member 14 facing the terminal 6c is a positioning nib 14b which passes through a correspondingly shaped laterally open, elongated slot 37 (see FIG. 12) in the terminal extension 6c. The slots 37 and 39 are open and elongated rather than confined circular openings to maximize tolerances. The design of the parts just described are such that the parts can be either automatically or manually assembled by dropping one part into another part, and pressing the parts together to cause the positioning nibs 14a and 14b which have tapered outer ends to guide the sandwich of the blade 12, insulating member 14 and terminal extension 6c into a precise predetermined relationship prior to the application of the rivet 16. This assembly operation can be carried out before or after the terminal 6 is mounted upon the support base 2.

Also, either prior to or after the mounting of the terminals 6 and 6' upon the support base 2, in the most preferred form of the invention, the terminal 6' is welded directly to the base portion 12a of the heat responsive blade 12. To this end terminal 6' has a bottom portion 6a' which is to extend through and beyond the support base, a short intermediate portion 6b' which extends along the upper surface of the thick portion 2a of the support base 2, and a short upwardly extending end portion 6c', the edge portion of which is welded directly to the base portion 12a of the heat responsive blade 12, as best shown in FIGS. 3, 5 and 6.

As previously indicated, terminals 6 and 6' are mounted upon the support base 2 in a very unique manner. For this purpose the support base 2a must be made of a thermoplastic material so when ultrasonic vibrations are applied thereto it will soften or melt. The terminal 6 and 6' extend respectively through apertures 48 and 48' formed in the insulating base 2 which initially are smaller than the corresponding dimensions of those portions of the terminals which fit therein when the terminals are fully mounted within the openings. Viewed in plan view in FIG. 18, the openings 48' or 48 has narrow end portions like 48a'–48a' and a wider intermediate portion like 48b'. Terminals 6 and 6' are metal stampings providing relatively rigid thin blade-like configurations. The bottom end portions 6a and 6a' of the terminals 6 and 6' have upwardly and outwardly inclined side edge portions 44—44 and 44'–44' which reach a width somewhat greater than the corresponding lengths of the association support base apertures 48 and 48'. The inclined side edge portions 44—44 and 44'—44' terminate in anchoring apertures 46—46 and 46'—46'. The metal stock from which the terminal members are formed is thinner than the width of the corresponding end portions 48a—48a' of the apertures 48 and 48', but the overall thickness of the bottom end portions of the terminal members is made somewhat thicker than this width by pairs of horizontally spaced embossments 40—40 and 40'—40' pressed from or stamped in the terminals 6 and 6' at points adjacent anchoring aperture 46—46 and 46'—46' so they project from the side of the terminals on which the horizontally extending intermediate portions 6b—6b' of the terminals extend.

To mount the terminals 6 and 6' in the corresponding support base apertures 48 and 48', it is merely necessary to initially insert the narrow bottom end portions of these terminals within the apertures 48 and 48' and to place an ultrasonic tool upon the horizontally extending intermediate portions 6b and 6b' of these terminals and push downwardly on the tool to force the terminal members within the apertures 48 and 48'. The ultrasonic vibrations communicated to the thermoplastic material lining the apertures 48 and 48' cause this material to soften so that the plastic material flows along and within the various surfaces including the defining walls of the anchoring apertures 46—46 and 46'—46' to form an extremely secure connection between the terminal members and the support base 2. The embossments 40—40 and 40'—40' effectively wedge and position the terminal members 6 and 6' within the apertures 48 and 48' in a transverse direction. The embossments 40—40' are tapered outwardly on all sides thereof and the overall thickness of the bottom end portions of the terminal members 6 and 6' at the points where the embossments are formed is such that they are somewhat greater than the corresponding dimensions of the wider intermediate portions 48c' or 48c of the apertures 48' or 48, so the embossments snugly fit into place within the support base apertures.

The intermediate horizontally extending portions 6b and 6b' of the terminals 6 and 6' are of a width at least equal to and preferably greater than the length of the apertures 48 and 48' in the support base so that once the terminals 6 and 6' have been finally positioned in place within the support base and the lateral position thereof is established by the embossments 40—40 and 40'—40', the horizontally extending intermediate portion 6b and 6b' extend from the longitudinal margins of the apertures 48 and 48' opposite to the longitudinal margins thereof engaged by the embossments. In such case, the intermediate terminal portions 6b and 6b' act as seals preventing the entry of dust and the like within the confines of the flasher member after the cover 4 is applied to the support base.

It should be understood that numerous modifications may be made in the most preferred form of the invention illustrated without deviating from the broader aspects thereof.

I claim:

1. A flasher device comprising: a support base; a pair of terminals anchored to said support base, one of the terminals having an inner extension with a stationary contact carried thereby and in direct electrical and physical contact therewith; a conductive heat responsive means having a movable contact in direct electrical and physical contact therewith and to be positioned in confronting relation to said stationary contact; an insulating member positioned between the heat responsive means and the terminal extension, and an insulated rivet clamping said heat responsive means and insulating member to said terminal extension, so the heat responsive means is insulated from said terminal extension, said other terminal being welded directly to said heat responsive means; and heating means electrically connected across the heat responsive means and the terminal extension to receive current until shunted by said contacts and positioned to heat at least portions of the heat responsive means to a temperature where it moves into a position where said movable contact carried thereby engages said stationary contact to short circuit the heating means until the heating means cools.

2. The flasher device of claim 1 wherein the insulating member has positioning projections extending into correspondingly sized apertures in the heat responsive means and the terminal extension to fix the relative positions thereof.

3. A circuit interrupting device comprising: a support base, a pair of terminals anchored to said support base for connecting said device into an electrical circuit, one of said terminals having an integral conductive inner extension having a stationary contact thereon in physical and electrical contact therewith, electrically conductive heat responsive means electrically connected to the other terminal and carrying a movable contact in physical and electrical contact therewith, said heat responsive means when at least a portion thereof is heated to a given temperature assuming a first movable contact operating position and when cool assuming a second contact operating position, said movable contact being moved into and out of engaged and separated positions with said stationary contact as said heat responsive means moves respectively between said first and to said second movable contact operating positions, an insulating member positioned between said terminal extension and said heat responsive means, heating means for heating said portion of said heat responsive means to said temperature when the current flows therethrough, said heating means being connected to receive current only when said movable contacts are in one of said positions, securing means electrically insulated from at least one of said terminal extensions and heat responsive means for anchoring said insulating member and heat responsive means to said terminal extension so said movable contact carried by said heat responsive means is in confronting relation to said stationary contact whereby current flow therein is established and interrupted by operation of said movable contacts as said heat responsive means moves respectively to said second and first contact operations positions, and said insulating member having positioning means interfitting with said terminal extension and heat responsive means to fix the relative relationship thereof.

4. The circuit interrupting device of claim 3 wherein said interfitting means of said insulating member are projections therefrom extending into correspondingly sized apertures in said terminal extension and heat responsive means.

5. The circuit interrupting device of claim 3 wherein said other terminal is directly welded to said heat responsive means.

6. The circuit interrupting device of claim 3 wherein said securing means is a rivet.

7. The circuit interrupting device of claim 6 wherein said rivet is made of metal and has a head portion bearing directly against one of said terminal extensions and heat responsive means and a staked end bearing against a washer insulating it from the other of same.

8. The circuit interrupting device of claim 3 wherein said insulating member is spaced from said support base base and is anchored to and carried by said inner extension of said one terminal, said heat responsive means including a flexible plate-like body carrying said movable contact and welded directly to said other terminal.

9. The circuit interrupting device of claim 8 wherein said heat responsive means in addition to said plate-like body includes a heating element electrically connected in parallel with the stationary and movable contacts, said heating element being operative to effect movement of said plate-like body to a contact closing position when said heating element is below a given temperature and operative to effect movement of said plate-like body to a contact opening position when said heating element is above said given temperature.

* * * * *